United States Patent [19]

Montgomery et al.

[11] Patent Number: 5,060,573

[45] Date of Patent: Oct. 29, 1991

[54] DETONATOR ASSEMBLY

[75] Inventors: Mike Montgomery, Stephenville; Scott L. Hayes, Burleson, both of Tex.

[73] Assignee: Goex International, Inc., Gleburne, Tex.

[21] Appl. No.: 630,281

[22] Filed: Dec. 19, 1990

[51] Int. Cl.[5] ..... F42B 3/182

[52] U.S. Cl. ..... 102/202.5; 102/200; 102/275.6; 102/322

[58] Field of Search ..... 102/200, 202.5, 202.12, 102/202.14, 275.6, 275.11, 275.12, 322

[56] References Cited

U.S. PATENT DOCUMENTS

| | | | |
|---|---|---|---|
| 1,537,668 | 5/1925 | Grant | 102/322 |
| 2,965,032 | 12/1960 | Borcher et al. | 102/322 |
| 3,244,103 | 4/1966 | Spickard | 102/202.5 |
| 4,998,477 | 3/1991 | Barker | 102/275.6 |

*Primary Examiner*—Charles T. Jordan
*Attorney, Agent, or Firm*—Arthur F. Zobal

[57] ABSTRACT

A metal detonator housing has a central opening extending therethrough between upper and lower ends and a detonator located in the opening at the lower end. Two leads are conenected to the detonator for causing the detonator to explode upon the application of electrical energy to the two leads. A metal contact spring is located in the opening of the housing at the upper end and extends out of the upper end. The contact spring is electrically insulated from the housing. A spring is located in the opening of the housing and is coupled to the detonator for urging the detonator toward the lower end. One electrical leads extends from the detonator through the central opening of the housing and is electrically connected to the contact spring. The other electrical lead is electrically coupled to the housing.

A shunting wire is provided with means for removably attaching one end of the shunting wire to the outside of the housing with the other end of the shunting wire being removably connected to the contact spring.

Also provided is a body member having a central opening extending therethrough for receiving the detonator housing with the detonator located next to an explosive load assembly. A firing head is provided which is adapted to be screwed into the other end of the body member to electrically engage the contact spring with a central contact member and to electrically connect the housing of the firing head to the body member.

6 Claims, 2 Drawing Sheets

DETONATOR ASSEMBLY

FIELD OF THE INVENTION

The invention relates to a detonator assembly to be used in a borehole for actuating a utilization device.

BACKGROUND OF THE INVENTION

Prior detonator devices used in boreholes drilled in the ground for the oil industry, tended to be unsafe and were difficult to assemble since field wiring was required.

SUMMARY OF THE INVENTION

It is an object of the invention to provide a new and unique detonator assembly which is safe in that it does not require field wiring and is easy to install and is more reliable than prior detonating assemblies. Moreover the assembly may be readily checked or tested and also has a shunting arrangement for shipping for safety purposes.

The detonator assembly comprises a metal detonator housing means having a central opening formed therethrough between first and second ends and a detonator located in the opening at the first end. First and second electrical leads are connected to the detonator for causing the detonator to explode upon the application of electrical energy to the two leads. A metal contact spring is located in the opening of the housing means at said second end and extends out of the second end. Electrical insulating means is provided for electrically insulating the contact spring from the housing means. A spring is located in the opening of the housing means and is coupled to the detonator for urging the detonator toward said first end. The first electrical lead extends from the detonator through the central opening of the housing means and is electrically connected to the contact spring. The second electrical lead is electrically coupled to the housing means.

A shunting wire is provided with means for removably attaching one end of the shunting wire to the outside of the housing means with the other end of the shunting wire being removably connected to the contact spring.

Also provided is a body member having a central opening formed therethrough for receiving the detonator housing means with the detonator located next to an explosive load assembly such as a tubing cutting tool. A firing head is provided which is adapted to be screwed into the other end of the body member to electrically engage the contact spring with a central contact member and to electrically connect the housing of the firing head to the body member which is electrically connected to the detonator housing means.

In the assembly procedure, the shunting wire is removed prior to insertion of the detonator housing means into the opening of the body member.

DETAILED DESCRIPTION OF THE PREFERRED EMBODIMENTS

Figure 1:
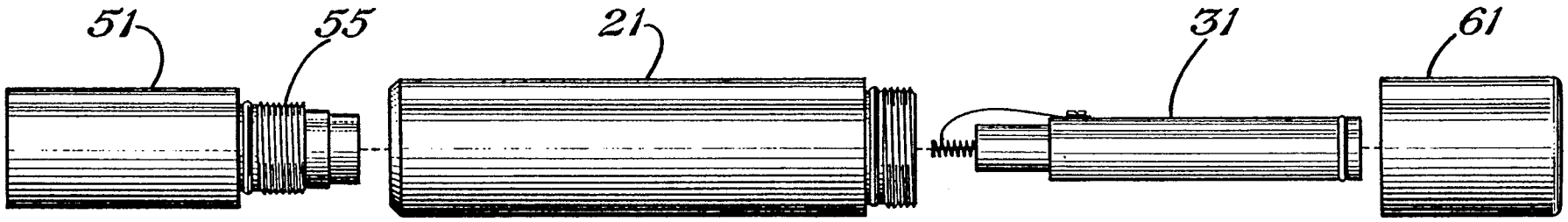
FIG. 1 is an exploded view showing a detonator housing means, a body member for receiving the detonator housing means, a firing head, and an explosive load assembly for holding a utilization device such as a tubing cutter for connection to the other end of the body member.
Figure 2:
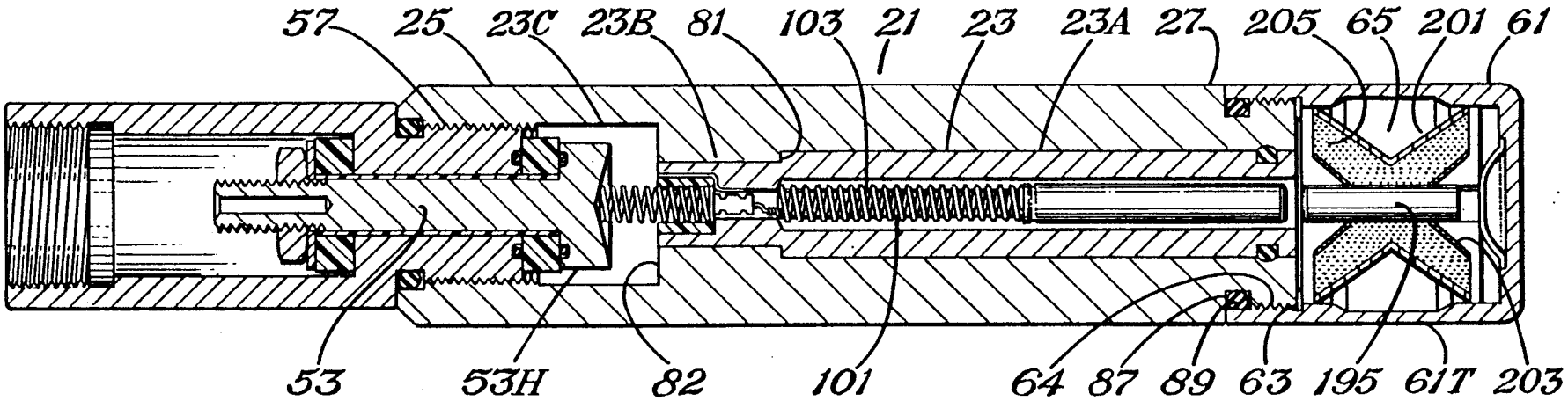
FIG. 2 is an enlarged cross-sectional view of the detonator housing means coupled to the firing head and to the explosive load assembly. The detonator is shown located in the detonator housing means.

Referring now to the drawings, there is disclosed a body member or top sub 21 having a central opening 23 formed between two ends 25 and 27. End 25 is the upper end and end 27 is the lower end. A metal detonator housing member 31 is provided having a central opening 33 formed therethrough between two ends 35 and 37 for receiving a detonator 41, a helically coiled metal spring 43 connected to the detonator 41, an electrically insulated butt connector 45 and a helically coiled metal contact spring 47. Reference numeral 51 identifies a metal firing head having a central metal contact rod 53. The firing head 51 has external threads 55 at one end screwed into internal threads 57 of the sub 21 for engaging the head 53H of the rod 53 with the contact spring 47. A load housing member 61 is provided having internal threads 63 adapted to be screwed to external threads 64 of the sub 21 to locate a utilization device 65 next to the detonator 41. The utilization device 65 shown is a tubing cutter although it could be a different type of device. A shunting wire 71 has one end 74 removable connected to the housing member 31 by way of a metal screw 73. The other end 75 of the shunting wire 71 is removably crimped to the contact spring 47. Prior to insertion of the housing member 31 into the opening of the sub 21, the screw 73 and the shunting wire 71 are removed from the housing 31 and from the contact spring 47. The sub or body 21 is formed of metal which may be aluminum. The central opening 23 has a shoulder 81 facing the end 27 and an enlarged opening 23C in which the threads 57 are formed. A shoulder 82 faces the end 25 of the sub. Also provided is an annular groove 87 for receiving a resilient O-ring 89. The opening 23 is cylindrical or circular in cross-section in zones 23A, 23B and 23C

The detonator housing 31 has an outer cylindrical portion 31A and a reduced diameter cylindrical portion 31B with a shoulder 31S formed therebetween. The housing 31 preferable is formed of aluminum. The opening 33 comprises a cylindrical portion 33A and a narrower cylindrical portion 33B and a further enlarged cylindrical portion 33C. Shoulders 95 and 97 are formed between opening portions 33B and 33A and 33B and 33C respectively. The detonator 41 is a cylindrical member which holds an explosive charge. The metal spring 43 has one end 43A attached to one end 41A of the detonator. Electrical leads 101 and 103 are connected to the detonator 41 and extend through the central opening of the coiled spring 43. An electrically insulating hollow cylindrical member 105 is located in the enlarged opening portion 33C and has one end which abuts against the shoulder 97. The spring contact 47 is a helically coiled metal spring which is located within the opening of the member 105 which electrically insulates spring 47 from the housing 37. The spring 47 has a wire end portion 47A which extends through the butt connector 45. The end 47A of the spring is connected to the lead 101 by crimping. The lead 103 extends from the coiled spring 43 through the opening portion 33B against the shoulder 97 and then between the opening portion 33C and the exterior of the annular member 105. The leads 101 and 103 preferable are insulated. The bear end of lead 101 is electrically connected to the end 47A of the coiled spring 47. The lead 103 has its insulation removed between the interior wall of the housing 31 forming the opening 33C and member 105 such that it electrically engages the housing 31 which is formed of aluminum. A threaded aperture 111 is formed into the housing 31 for receiving the screw 73. The end 75 of the wire 71 is removably crimped to the coil contact spring 47. An annular slot 113 is formed in the end 37 of the housing member 31 for receiving the resilient O-ring 115.

The firing head 51 comprises a metal housing member 121 having a metal contact rod 53. A central opening 123A and 123B is formed through member 121 with a shoulder 125 formed between the opening portions 123A and 123B. The opening portions 123A and 123B are cylindrical in shape and internal threads 127 are formed at the end of the opening portion 123B. The firing head housing member 121 is formed of metal such as aluminum. A hollow cylindrical electrically insulated sleeve 131 is located in the opening portion 123A for receiving the shank of the rod 53. The end of the shank is threaded at 133. An electrically insulating washer 151 is located around the insulating member 131 next to the head 53H. In addition an electrically insulating washer 161 is located around the insulating member 131 at the other end. Member 163 is an electrically insulating washer. Thus rod 53 is electrically insulated from housing member 121. The contact rod 53 is held in place by screwing a nut 165 to the threads 133. An annular slot 171 is formed in the backside of the head 53H and an annular slot 173 is formed in the front end of the housing member 121 for receiving two flexible O-rings 175 and 177 respectively. Member 179 also is flexible O-ring.

The load housing member 61 holds an explosive load member 65 which may be a tubing cutter for cutting tubing or pipe in the borehole and located around the assembly 51, 21, 31, and 61 through which it is lowered. The housing member 61 has an open end with threads 63 adapted to be screwed to the threads 64 of the sub 21. Also provided is a booster detonator 195 which extends through the tubing cutter 65. The tubing cutter 65 comprises cone shaped members 201 and 203 for holding an explosive charge 205.

The purpose of the shunting wire 71 and the screw 73 is to prevent the detonator 41 from prematurely exploding before it is fitted in the sub 21. In addition, the screw 73 prevents the housing 31 from being inserted into the sub 21 until the screw 73 and shunting wire 71 are removed.

Figure 3:
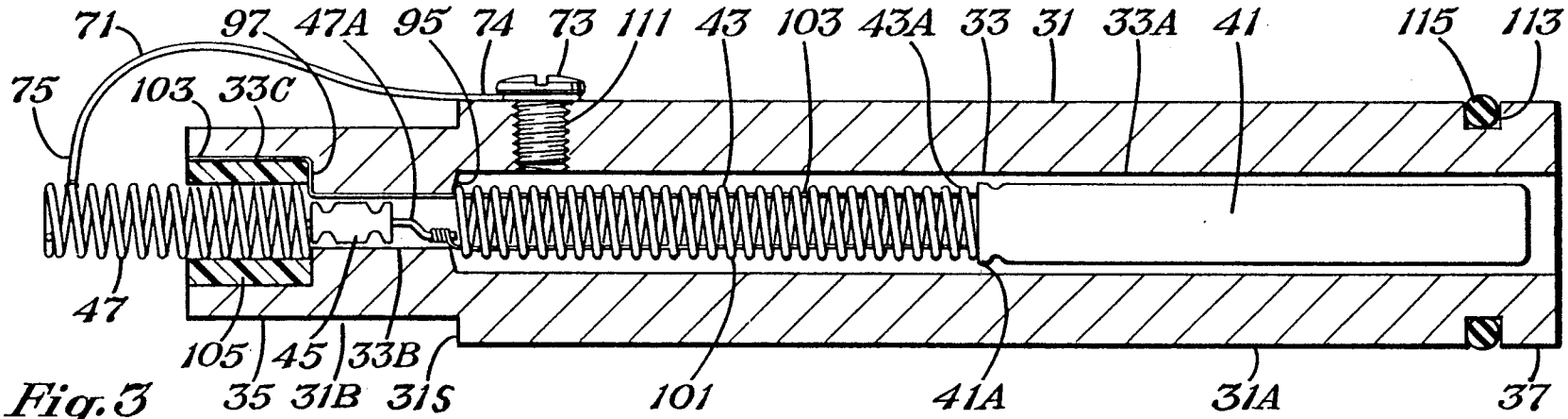
FIG. 3 is an enlarged cross-sectional view of the detonator housing means and detonator of FIGS. 1 and 2.
Figure 4:
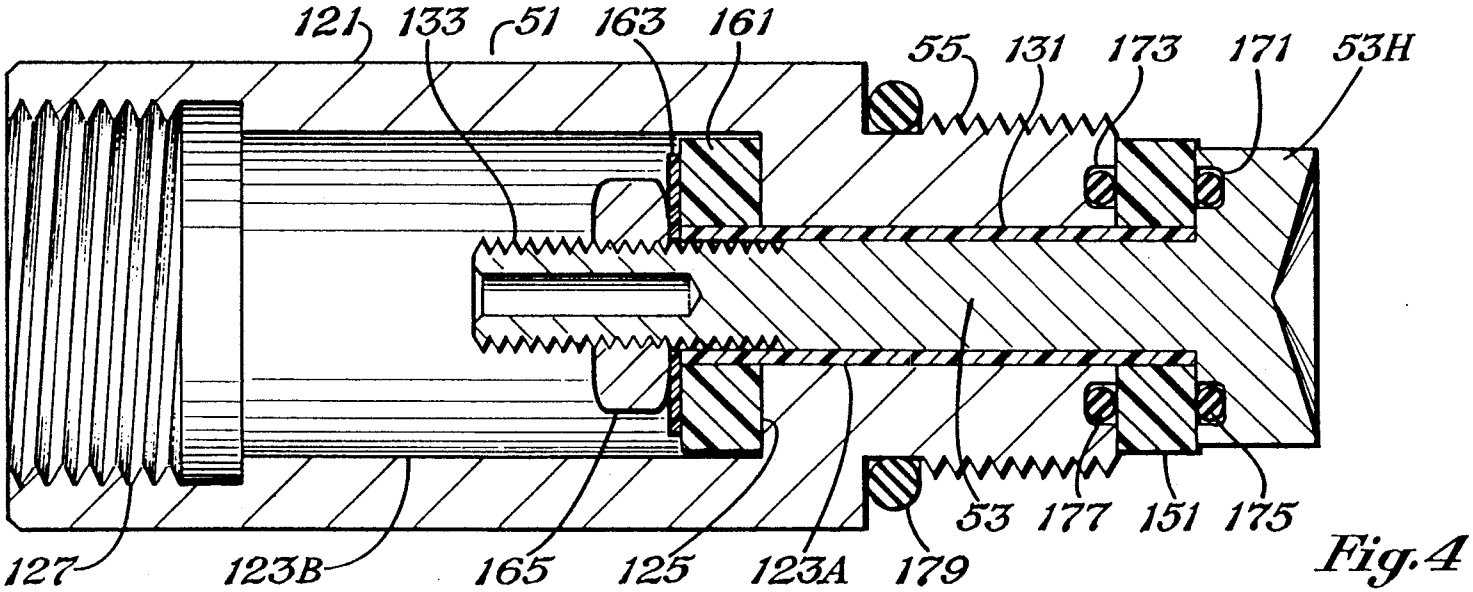
FIG. 4 is an enlarged cross-sectional view of the firing head of FIG. 1 and 2.

In assembling the detonator 41 and spring 43 in the housing 31, the spring 43 and detonator 41 are inserted into the opening 33 from the end 37 with the wires 101 and 103 extending through the coiled spring 43. The spring 43 will abut against the shoulder 95 and the wires 101 and 103 can be pulled to compress the spring 43 against shoulder 95 to allow crimping of the wire 101 to the contact spring end 47A and the wire 103 to be inserted between the annular member 105 and the inside wall 33C of the housing member 31. After this is done, the spring 43 will urge the detonator 41 towards the end 37 of the housing member. The shunt wire 71 then can be attached to the housing 31 with screw 73 and its end 75 crimped to the contact spring 47. This assembly can be done in the shop and the unit of FIG. 3 shipped to the field.

In assembling the apparatus in the field the screw 73 and the shunting wire 71 are removed and the detonator housing 31 with its detonator 41 and its spring 43 and contact spring 47 are inserted into the central opening of the sub 21 from its end 27 and the firing head 51 is screwed into the other end of the sub 21 to cause the head 53H of the rod 53 to make electrical contact with the contact spring 47. Next the load assembly 61 is screwed to the lower end 27 of the sub 26. Electrical connection is had between the firing head rod 53 and the detonator 41 in the following manner. The hot wire 101 from the detonator is electrically connected to the contact 47 which in turn is electrically connected to the firing head rod 53 which will then be electrically connected to a lead which will extend to the surface. The lead 103 is a ground wire which electrically connects the detonator 41 to the housing 31 which in turn is electrically coupled to the sub housing 21 which in turn is electrically connected to the housing 121 of the firing head 51. Thus ground connection is made with the detonator by way of the housing 31, the housing 21, and the housing 121 of the firing head the latter of which will be connected to an electric wireline which will extend to the surface. The assembly can be inserted through the borehole pipe to a level where it is desired to cut the borehole pipe. The application of electrical energy to the two leads 101 and 103 will cause the detonator 41 to explode which in turn will cause the booster charge 195 to explode to actuate the cutter 65 which will penetrate the thin portion 61T of the housing 61 and perform the cutting operation of the outer downhole tubing or pipe.

The detonator assembly system has advantages in that the detonator housing 31 and its detonator do not require wiring in the field. It is also shunted for shipping and the detonator housing cannot be assembled into the sub housing while it is shunted. There is also safety provided in that the system can be checked without being capped in and the detonator cannot be pinched. The detonator is centralized and in the proper position above the explosive load. The system is easy to install since the detonator housing 31 is readily placed in the sub housing 21. In addition, the system can be used on all tools employing a 1½ inch firing head. The new style detonator 41 allows for better detonation train to the load and the system is more reliable and there is a built in safety housing 21 for checking the continuity of the detonator. An air gap is provided between the detonator 41 and the booster detonator 195 to prevent the system from exploding prematurely when assembled.

We claim:

1. A detonator assembly, comprising:

a metal housing means having a central opening formed therethrough between first and second ends, a detonator located in said opening at said first end, first and second electrical leads connected to said detonator for causing said detonator to explode upon the application of an electrical energy to said first and second leads, a metal contact spring located in said opening of said housing means at said second end and extending out of said second end, electrical insulating means for electrically insulating said contact spring from said housing means, an interior spring located in said central opening of said housing means for urging said detonator toward said first end, said first electrical lead extending from said detonator through said central opening of said housing means and electrically connected to said contact spring, said second electrical lead being electrically coupled to said housing means.

2. The detonator assembly of claim 1, comprising:

first and second shoulders extending radially inward in said central opening of said housing means, said first shoulder facing said first end of said housing means and said second shoulder facing said second end of said housing means, said interior spring having a first end coupled to said detonator and a second end engaging said first shoulder for urging said detonator toward said first end of said housing means, said contact spring comprising a coiled spring, said electrical insulating means comprising a hollow annular member having a central opening supporting said contact spring within its central opening.

3. The detonator assembly of claim 1, comprising:

a threaded aperture formed in said housing means, a shunting wire, a threaded member adapted to be screwed into said threaded aperture for removably electrically connecting one end of said shunting wire to said housing means, the other end of said shunting wire being removably connectable to said contact spring.

4. The detonator assembly of claim 2, comprising:

a threaded aperture formed in said housing means, a shunting wire, a threaded member adapted to be screwed into said threaded aperture for removably electrically connecting one end of said shunting wire to said housing means, the other end of said shunting wire being removably connectable to said contact spring.

5. The detonator assembly of claim 1, comprising:

a metal support body having a central opening extending therethrough between first and second ends, said housing means being located in an operating position in said central opening of said support body with said first end of said housing means located at said first end of said support body and said housing means and said support body being in electrical contact with each other, a utilization means connected to said first end of said support body to be actuated to perform a given function upon explosion of said detonator;

said spring contact of said housing means extending into said central opening of said support body when said housing means is located in said operating position in said central opening of said support body, the structure of said support body forming said central opening of said support body at said second end thereof having internal threads, a metal firing head means having a central opening extending between first and second ends, a metal contact means located in said central opening of said firing head means and having a contact end extending out of said first end of said firing head means for electrically contacting said contact spring, means for electrically insulating said contact means from said firing head means, external threads formed at said first end of said firing head means for allowing said first end of said firing head means to be screwed to said internal threads of said support body for moving said first end of said firing head means into said central opening of said support body for electrically engaging said contact means with said contact spring and for electrically connecting said firing head means with said support body to electrically couple said firing head means with said housing means.

6. The detonator assembly of claim 2, comprising:

a metal support body having a central opening extending therethrough between first and second ends, said housing means being located in an operating position in said central opening of said support body with said first end of said housing means located at said first end of said support body and said housing means and said support body being in electrical contact with each other, a utilization means connected to said first end of said support body to be actuated to perform a given function upon explosion of said detonator;

said spring contact of said housing means extending into said central opening of said support body when said housing means is located in said operating position in said central opening of said support body, the structure of said support body forming said central opening of said support body at said second end thereof having internal threads, a metal firing head means having a central opening extending between first and second ends, a metal contact means located in said central opening of said firing head means and having a contact end extending out of said first end of said firing head means for electrically contacting said contact spring, means for electrically insulating said contact means from said firing head means, external threads formed at said first end of said firing head means for allowing said first end of said firing head means to be screwed to said internal threads of said support body for moving said first end of said firing head means into said central opening of said support body for electrically engaging said contact means with said contact spring and for electrically connecting said firing head means with said support body to electrically couple said firing head means with said housing means.

* * * * *